United States Patent [19]

Longo

[11] 4,327,943

[45] May 4, 1982

[54] MATERIAL HANDLING BUCKET ARRANGEMENT

[75] Inventor: Joseph F. Longo, Wilton, Conn.

[73] Assignee: Condor International Corporation, South Norwalk, Conn.

[21] Appl. No.: 136,765

[22] Filed: Apr. 3, 1980

Related U.S. Application Data

[60] Continuation of Ser. No. 959,580, Nov. 13, 1978, abandoned, which is a division of Ser. No. 775,208, Mar. 7, 1977, Pat. No. 4,143,900.

[51] Int. Cl.[3] ..... B66C 3/02

[52] U.S. Cl. ..... 294/70; 37/183 R; 294/88

[58] Field of Search ..... 294/70, 71, 88; 37/71, 37/118 R, 118 A, 183 R, 183 A, 184–188; 414/624, 722, 726

[56] References Cited

U.S. PATENT DOCUMENTS

| | | | |
|---|---|---|---|
| 1,886,780 | 11/1932 | Ball | 37/118 R |
| 2,166,854 | 7/1939 | Bartlett | 37/184 X |
| 2,689,661 | 9/1954 | Przybylski | 37/184 X |

FOREIGN PATENT DOCUMENTS

| | | | |
|---|---|---|---|
| 227223 | 8/1958 | Australia | 37/184 |
| 1347075 | 11/1963 | France | 294/70 |
| 871650 | 6/1961 | United Kingdom | 294/70 |
| 934819 | 8/1963 | United Kingdom | 37/118 R |

*Primary Examiner*—Johnny D. Cherry

[57] ABSTRACT

A pair of bucket bowls are pivotally suspended from a power head frame on the exterior of which is mounted a pair of hydraulic rams. Each of the hydraulic rams has one end pivotally connected to the power head frame and another end pivotally connected to a respective bucket bowl. The power head frame houses power components for actuating the cams and is formed of a horizontal deck, and vertical side and end bulkheads integrally formed to provide a watertight enclosure.

2 Claims, 3 Drawing Figures

MATERIAL HANDLING BUCKET ARRANGEMENT

This is a continuation of application Ser. No. 959,580, filed Nov. 13, 1978, now abandoned, which itself is a divisional of Ser. No. 775,208, filed Mar. 7, 1977, now U.S. Pat. No. 4,143,900, issued Mar. 13, 1979.

BACKGROUND OF THE INVENTION

The present invention is directed to an electro-hydraulic bucket arrangement for material handling, and especially for digging into frangible material such as ore, scrap metal, grain and the like, and the transport of such dug-up material to another location.

Bucket arrangements are well-known and typically fall into the class of mechanical buckets where two bucket bowls are pivotal toward and away from each other to gather material and transport it to a desired area. However, all of these prior bucket arrangements have been complicated and are difficult to maintain due to the many movable parts making up the arrangement, and particular to the open placement of the operative motors, pumps, hydraulic gear and controls so that they can be easily damaged during use.

A further difficulty in the prior art devices results from uneven distribution of the hydraulic power means with respect to the bowls.

A particular difficulty arises when it is desired to employ the bucket in "hot" material such as coke, ore and the like. The exposure of the power units, i.e. motors and pump, as well as the control units, severely restricts the depth to which the bucket can be immersed in the material, and therefore the amount of material capable of being grabbed in the bowls on closing.

It is an object of the present invention to provide a self-powered bucket overcoming the aforementioned difficulties and disadvantages.

It is another object of the present invention to provide a self-powered bucket in which the power units are housed in a water-tight and insulated enclosure, thereby permitting full immersion of the bowls.

It is another object of the present invention to provide a self-powered bucket wherein the bowls are pivoted in such a manner as to permitting them wide opening even under immersed conditions.

It is still another object of the present invention to provide a simple, economical construction and easily repairable buckets.

The foregoing objects, other objects as well as numerous advantages will be seen from the following disclosure of the present invention.

SUMMARY OF THE INVENTION

According to the present invention, a material handling bucket is provided comprising a pair of bucket bowls and a power head frame supporting the bucket bowls. The frame comprises a substantially horizontal deck, vertical side bulkheads and vertical end bulkheads connected together to form a watertight box-like enclosure. The bowls are pivotally mounted to the frame about a first axis to swing adjacent the respective end bulkheads between an open position for receiption of material and a closed position for transporting the material. A cross beam extends parallel to the side bulkheads and is fixed to the frame along its upper edge. A pair of hydraulic rams are respectively positioned exterior of each of the end bulkheads and are pivotally connected to the cross beam at one end and to the associated bowls at the other end about a second pivot axis. The mechanism for actuating the hydraulic ram is located within the water-tight frame and reciprocates the hydraulic ram moving the bowls selectively between the open and closed positions.

Preferably, the bucket includes a pair of plates straddling each of the hydraulic rams. The plates extend outward perpendicularly to the associated end bulkheads and from the cross beam to at least the deck, and are integrally secured to the cross beam, the end bulk heads and the deck and form an open tunnel in which the associated hydraulic ram sits. Further the bowls are formed with pentagonally shaped end walls, a bottom wall and a rear wall. The bowls are pivotally connected at the first pivot axis by bearings located at the apex of the side walls, and the hydraulic ram is connected to the rear wall. The first and second pivot axes are arranged so that the bowls swing between a position below the deck wherein the rear wall is maintained substantially vertical and a position adjacent to and surrounding the associated vertical end bulkheads, wherein the rear wall is maintained substantially horizontal.

Full details of the present invention are set forth in the following description and illustrated in the accompanying drawings.

BRIEF DESCRIPTION OF THE DRAWINGS

The invention will be more readily understood with reference to the following detailed description when taken in conjunction with the accompanying drawings, wherein.

DETAILED DESCRIPTION OF THE INVENTION

Figure 1:
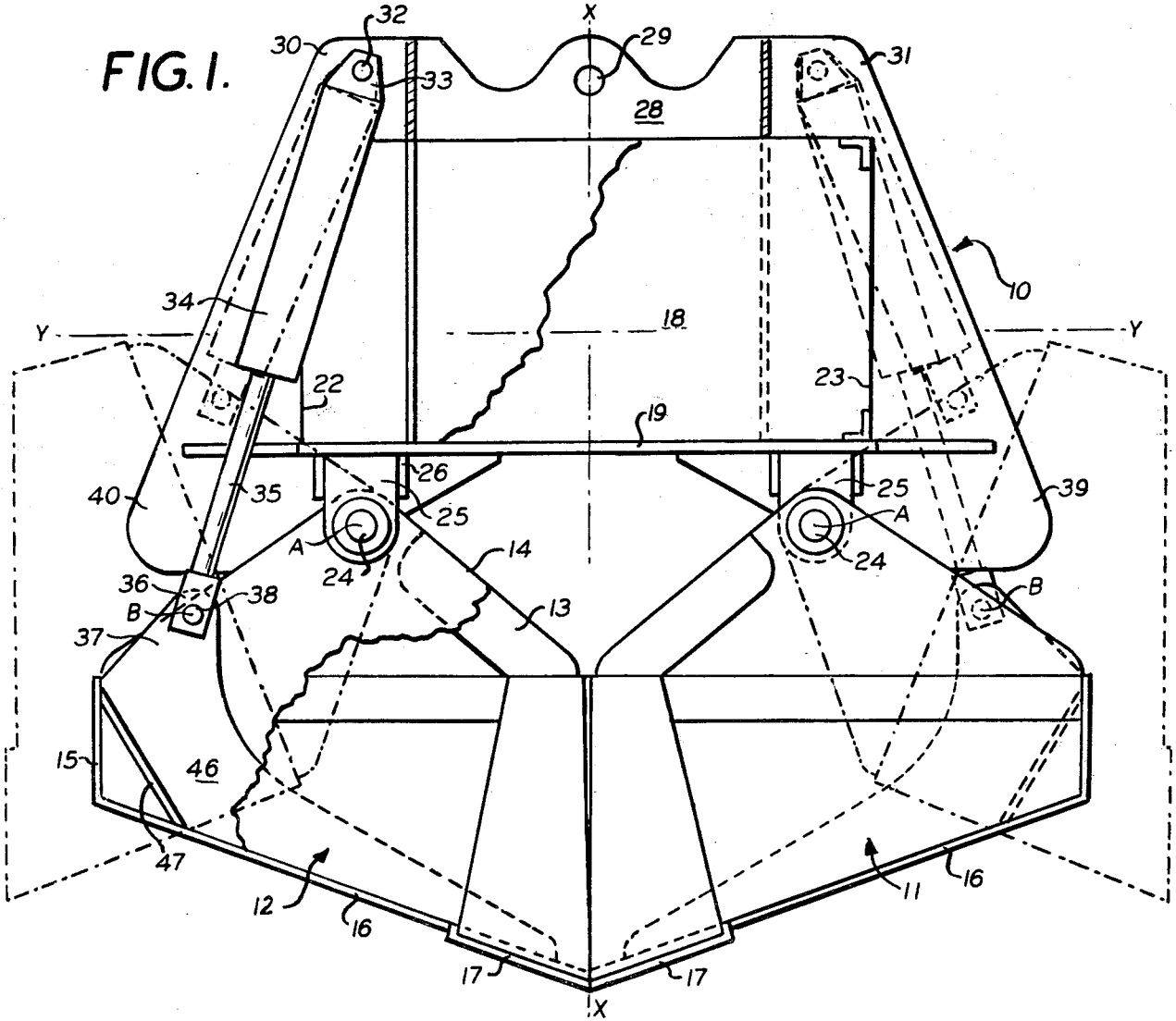
FIG. 1 is a side view showing the bucket arrangement of the present invention.
Figure 2:
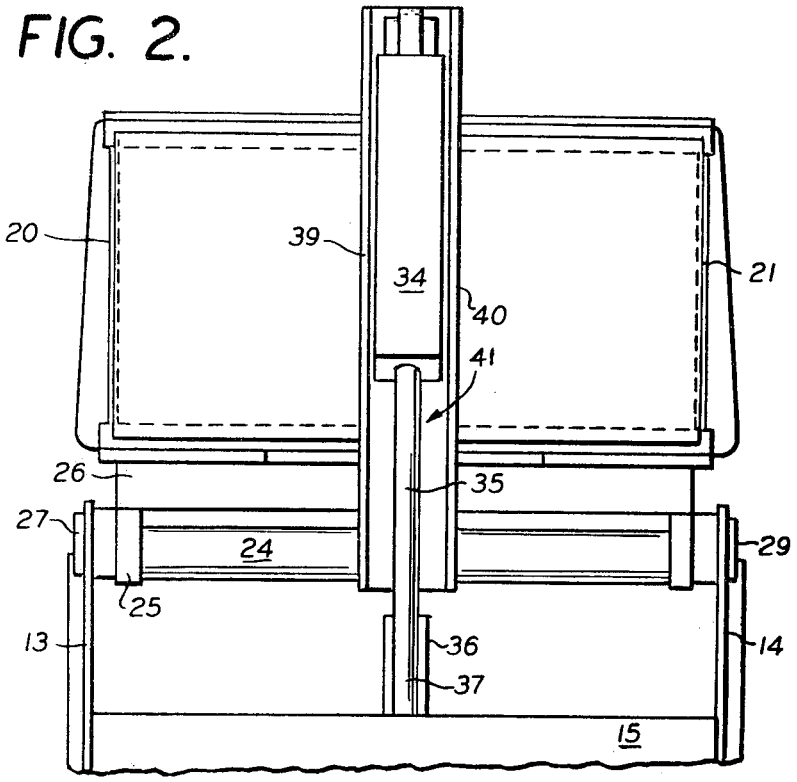
FIG. 2 is an end view of the bucket arrangement of FIG. 1, taken from the right.
Figure 3:
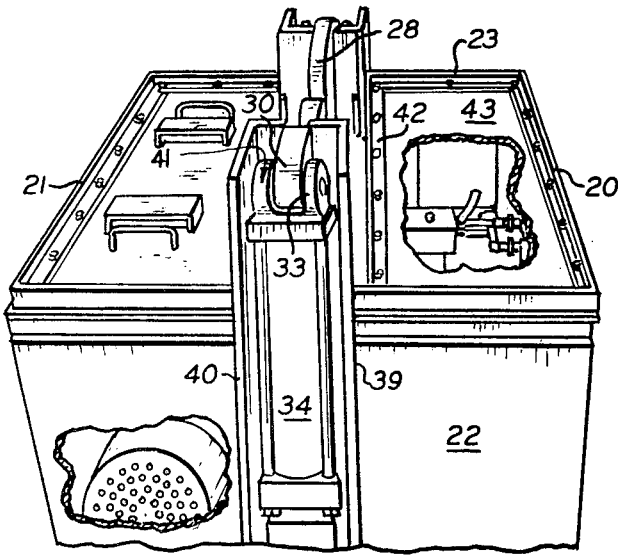
FIG. 3 is a perspective view of the bucket taken from the left top end thereof.

Referring now to the drawings, the bucket arrangement 10 of the invention is shown in FIGS. 1–3. The bucket arrangement has two conventional bucket bowls 11 and 12, each respectively having two parallel spaced side walls 13 and 14, a rear wall 15 and a bottom wall 16 having a protruding blade or cutting edge 17. The side walls are each generally pentagonal in shape with its rear edge and bottom edge extending at an obtuse angle to each other, so as to form a pair of scoop-like bowls meeting along a center line x—x.

The bowls are pivotally supported by and beneath a power head frame 18 comprising a deck plate 19 of rectangular configuration to which are welded a pair of side bulkheads 20 and 21 and end bulkheads 22 and 23 forming a watertight box structure, sealed about all its edges except for the top.

Each of the bowls are mounted on axle shafts 24 supported by a pair of inverted pillow blocks 25 welded to the bottom surface of the deck plate adjacent each of its respective corners. The paired pillow blocks are joined together by an angle brace 26 extending transversely to and across the deck plate. The side walls 13 and 14 of the bowls are keyed onto the ends of the axle shaft 24 and secured thereto by removable caps 27.

Extending across the frame above its top edge, is a heavy duty cross bar 28 having a central hole 29 to which a lift chain or crane hoist may be attached. The cross bar 28 extends parallel to the side bulkheads 20 and 21 and is welded to the upper lip of the end bulkheads 22 and 23. The respective ends 30 and 31 of the cross bar 28 extend beyond the end bulkheads 22 and 23 outwardly of the frame 18. Each of these ends 30 and 31 is respectively provided with a hole adapted to receive an axle 32 for holding the clevis end 33 of the cylinder of a hydraulic actuator 34 which has a ram 35 extending downwardly from the cross bar provided with another clevis 36, straddling a push web 37 welded to the rear wall 15 of the bowl, and extending perpendicularly thereto. An axle pin 38 secures the clevis 36 and plush plate 37.

Straddling each of the hydraulic actuators is a pair of vertical parallel plates 39 and 40 which extend from the top of the cross bar to the level of the axle shaft 24, to form a continuous tunnel 41 from top to bottom. The plates 39 and 40 are pear-shaped so as to be somewhat larger at their bottoms accommodating any outward swing of the ram during its pivoting of the bowl.

The plates 39 and 40 are welded by cross braces 42 to the cross bar 28, directly to the end bulkheads 22, 23 of the frame and attached to the angle brackets straddling the axle 24. As a consequence, the cross bar is directly interconnected with the unitary frame, and the support for the axle shafts holding the bowls, so that all forces due to weight, gravity, etc., are uniformly and evenly distributed over the entire bucket.

It will be observed that each bowl is pivotably held at two points A and B corresponding to the central axes of the axle shaft 24 and the axle pin 38. The point B is offset from that of point A (which is at the apex of the side plate) both outwardly and downwardly so that on outward extension of the actuating ram the forward cutting edge of the bowl can be positively moved at least to and somewhat beyond the central meeting line x—x of the bucket, without any difficulty and on retraction of the actuating arm the bowl can be swung upward to the full retraction of the arm placing the bottom plate in an almost vertical position and the rear wall in a horizontal position, substantially along the line Y—Y. As observed, line Y—Y is well below the upper lip of the watertight frame, therefore the bucket can be fully immersed in the material being handled, in completely open position, without any possibility of the material entering into the frame.

It will be observed that the side walls of the bowl are spaced apart, a distance somewhat greater than the parallel side bulkheads of the frame so that the bowl can be raised to the upward level Y—Y without interference from the frame. Desirably, however, fenders may be arranged to extend outwardly from the side bulkhead to engage the edge of the bowl, to limit the upward movement.

The frame is provided with a pair of cover members 43 which are attached to the upper lip of frame by screws, hooks or latch fasteners of any conventional type. The covers are preferably provided with vents enabling circulation of air within the otherwise hermetically sealed frame. The vents may be provided with screens or the like to prevent large rocks or other particles from falling to the frame.

Optionally, the push web 37 of the bowl may extend downwardly along the rear wall 15 and forwardly along the bottom wall 16 in a decreasing taper to provide a central strengthening rib 46 connecting the rear and bottom walls. It is also preferable to employ a transverse strengthening member 47 secured cater-cornered across the angle between the rear and bottom walls. This cater-corner brace is welded to the rear and bottom walls as well as to the side walls, and effectively forms a closed triangular tube which prevents torque and twist in the bowl, caused by uneven digging or uneven loads.

Mounted within the power head frame, are the components for driving the hydraulic actuators including a source of fluid, a compressor, a pump, an electric motor, manifold units and control units. An umbilical cord extends along the hoist chain or the like through the cover into the interior for actual control. These components may be arranged in the manner set forth in copending application Ser. No. 775,207, now U.S. Pat. No. 4,129,329, filed herewith in the name of the present inventor. Specific reference to FIG. 6 of that application may be made.

Conventional arrangements may also be used, but since the present apparatus is a two bowl bucket, each powered by a single ram, it is essential however, to maintain equalization of the ram pressure in both the outward and inward strokes, so that even under uneven loads the bowls move simultaneously, and therefore some arrangement of division of the hydraulic fluid must be made.

Since the bucket arrangement of the invention is self-powered, and since all of the power components are housed in one frame, maintenance of the device is assured in an easy and inexpensive way. The top covers of the power head frame 18 are removable by any convenient method to allow access to the power components in case of replacement or repair.

In general, the hydraulic lines to the actuators can extend over the top of the end bulkheads, or if desired, through the bulkheads with the use of suitable seals and packings.

It will however, be appreciated from the foregoing that the several objects set forth initially have been met by the novel construction provided by the present invention. The box-like unitary frame forming the housing is rigid, strong and evenly distributes loading and force conditions so that twisting of the bowls and/or the frame is substantially eliminated. The water box construction further permits the housing of all of the operating components out of any damage of contamination or harm. The arrangement of the bowls relative to the housing frame, permits open insertion of the bucket in harmful materials, even liquids, so that the bowl is completely covered in open condition, and allows the bowl to be closed, to contain, a full load, before being lifted from the material, all without any possibility of contamination of the operative components.

The bucket is further extremely useful in handling hot materials such as coke, ash and the like. The watertight housing protects and insulates the operative components while the wing-like plates forming a tunnel about the actuator in combination with the walls of the bowl rams similarly protect the rams from direct contact with the material as well as provide an air tunnel and radiating means for cooling.

While a specific embodiment of the invention has been shown and descrived, it is to be understood that numerous changes and modifications may be made without departing from the scope and spirit of the invention.

What is claimed:

1. A bowl for a material handling bucket pivotally mounted to a frame, said bowl comprising polygonal shaped side walls, a rear wall and a bottom wall, said rear and bottom walls intersecting at an angle substantially perpendicular to each other, a push plate integral with the rear wall and extending in a plane between and parallel to the side walls, said side walls of the bowl extending above the upper edge of said rear wall and being pivotally journalled to said frame, ram means for moving said bowl connected at one end to the upper portion of said push plate remote from said intersection, and means for forming a unitary tubular brace extending cater-corner to the interior surface of intersection of said rear and bottom walls between said side walls and being integral with said rear wall, said push plate, said bottom wall and said side walls preventing torsional movement between said walls and to interconnect said push plate with said side walls transmitting the force of the ram means directly to the side walls.

2. The bowl according to claim 1, wherein said brace means comprises a flat plate integrally welded to said side, rear and bottom walls.

* * * * *